US007992350B2

(12) United States Patent
Vriens

(10) Patent No.: US 7,992,350 B2
(45) Date of Patent: Aug. 9, 2011

(54) COLUMN BORNE BUILDING CONSTRUCTION

(75) Inventor: Luc Vriens, Keerbergen (BE)

(73) Assignee: Four Elements N.V., Keerbergen (BE)

( * ) Notice: Subject to any disclaimer, the term of this patent is extended or adjusted under 35 U.S.C. 154(b) by 254 days.

(21) Appl. No.: 12/302,144

(22) PCT Filed: May 23, 2007

(86) PCT No.: PCT/BE2007/000050

§ 371 (c)(1),
(2), (4) Date: Nov. 24, 2008

(87) PCT Pub. No.: WO2007/134411

PCT Pub. Date: Nov. 29, 2007

(65) Prior Publication Data

US 2009/0183439 A1 Jul. 23, 2009

(30) Foreign Application Priority Data

May 23, 2006 (GB) ..... 0610173.7

(51) Int. Cl.
*E04B 1/34* (2006.01)
*E04H 12/10* (2006.01)

(52) U.S. Cl. ..... 52/40; 52/81.2; 52/DIG. 10; 52/73

(58) Field of Classification Search ..... 52/73, 82, 52/223.4, 223.6, 296, 651.01, 651.04, 651.07, 52/651.11, 81.1, 81.3, 81.2, DIG. 10, 40
See application file for complete search history.

(56) References Cited

U.S. PATENT DOCUMENTS

| | | | | | |
|---|---|---|---|---|---|
| D39,522 | S | * | 9/1908 | Singer | D25/19 |
| 2,979,064 | A | * | 4/1961 | Fischer | 52/2.21 |
| 3,246,431 | A | * | 4/1966 | Faerber | 52/65 |
| 3,255,990 | A | * | 6/1966 | Williams | 249/27 |
| 3,452,493 | A | * | 7/1969 | Mims | 52/73 |
| 3,455,069 | A | * | 7/1969 | Keyes | 52/73 |
| 3,600,865 | A | | 8/1971 | Vanich | |
| 3,633,325 | A | * | 1/1972 | Bartoli | 52/73 |

(Continued)

FOREIGN PATENT DOCUMENTS

DE 198 38 791 A1 3/2000

(Continued)

*Primary Examiner* — Robert J Canfield
*Assistant Examiner* — Brent W Herring
(74) *Attorney, Agent, or Firm* — Bacon & Thomas, PLLC

(57) ABSTRACT

A column borne building construction according to the present invention comprises a building and one substantially vertical column for bearing the load of said building construction. The building has a polyhedron shape, this polyhedron shape having a top face defining a polygon shape by means of N1 top edges and N1 top vertices. The polyhedron shape comprises additional faces other than said top face, which additional faces are defined by additional edges and additional vertices. The top face is substantially perpendicular to the column and encircling the column. Each of the N1 top vertices join two top edges and at least one additional edge of the polyhedron. The column has a top coupling point and at least 3 of the N1 top vertices are connected to the column by means of a tension member. The extensions of these tension members coincide in the top coupling point.

20 Claims, 6 Drawing Sheets

U.S. PATENT DOCUMENTS

| | | | | | |
|---|---|---|---|---|---|
| D227,357 | S | * | 6/1973 | Wheeler | D25/19 |
| D236,976 | S | * | 9/1975 | Cannon | D25/23 |
| 3,905,166 | A | * | 9/1975 | Kaiser | 52/65 |
| 3,925,940 | A | * | 12/1975 | O'Connell et al. | 52/81.1 |
| 4,056,902 | A | * | 11/1977 | Ziegler, Jr. | 52/73 |
| 4,068,419 | A | * | 1/1978 | Decoppet | 52/40 |
| 4,173,102 | A | * | 11/1979 | Judge | 52/73 |
| 4,265,059 | A | * | 5/1981 | Johnson | 52/66 |
| 4,660,336 | A | * | 4/1987 | Cazaly et al. | 52/192 |
| 4,665,665 | A | * | 5/1987 | Wilkinson | 52/82 |
| 4,677,796 | A | * | 7/1987 | Mellott | 52/73 |
| 4,685,257 | A | * | 8/1987 | Richter | 52/73 |
| 4,703,594 | A | * | 11/1987 | Reber | 52/81.3 |
| 4,807,418 | A | * | 2/1989 | Ferguson et al. | 52/748.11 |
| 5,010,695 | A | * | 4/1991 | Schildge, Jr. | 52/6 |
| 5,236,625 | A | * | 8/1993 | Bardo et al. | 261/24 |
| 5,257,481 | A | * | 11/1993 | Reppas et al. | 52/6 |
| 5,267,420 | A | * | 12/1993 | Segman | 52/292 |
| 5,522,186 | A | | 6/1996 | Jarman | |
| D436,184 | S | * | 1/2001 | Reiter | D25/31 |
| 7,228,671 | B1 | * | 6/2007 | McCarten | 52/653.1 |
| 2009/0049763 | A1 | * | 2/2009 | Blundell et al. | 52/81.1 |
| 2010/0095605 | A1 | * | 4/2010 | Belicofski | 52/81.1 |

FOREIGN PATENT DOCUMENTS

| | | | | |
|---|---|---|---|---|
| FR | 1434354 | | | 2/1966 |
| GB | 2232695 | A | * | 12/1990 |
| JP | 05248001 | A | * | 9/1993 |
| WO | WO 2005/026461 | A1 | | 3/2005 |

* cited by examiner

COLUMN BORNE BUILDING CONSTRUCTION

TECHNICAL FIELD OF THE INVENTION

The present invention relates to column borne buildings, more particular to buildings being borne on one column as well as to methods of constructing the same.

BACKGROUND OF THE INVENTION

For building constructions in general, and column borne building constructions in particular, it is important to use the available volume as efficient as possible. As column borne building constructions have a larger outer surface as compared with traditionally founded buildings constructions, it is also very important to reduce as much as possible the outer surface for a given volume of the building construction, e.g. to reduce the thermal energy loss via the outer surfaces.

Buildings having a large volume/outer surface ratio are known from e.g. the geodesic domes of architect Buckminster Fuller. These domes have an outer surface approximating a spherical cap. It is known that a sphere has the largest inner volume-outer surface ratio. These domes can be constructed from lean rods, making up the edges of the different faces of the geodesic construction, which edges meet at the different vertices of the geodesic shape. The domes are self-supporting, i.e. the load of the construction is transferred to ground by means of several edges, contacting the earth.

Buildings having a polygon shape are also known, e.g. from WO2005/026461.

Column borne buildings are also known in the art. As an example, U.S. Pat. No. 3,600,865 shows a single column-borne elevated house. The house has a polygon shape and is coupled to the column by means of cantilever beams, both on the top side and the bottom side.

In order to bear the weight of the building, these cantilever beams are to be dimensioned significantly large, which both causes much material to be used thereby increasing the total weight of the construction because of the significant weight of the cantilever beams itself. The cantilever beams also have an influence on the esthetical outlook of the building, giving it a rather heavy and coarse outlook.

SUMMARY OF THE INVENTION

It is an object of the present invention to provide a column borne building comprising one column to bear the load of a polyhedron building as well as a method of constructing the same. It is an advantage of embodiments of the present invention that the load or weight of the polyhedron building is transferred to the column, optionally a central column, while avoiding the use of heavy cantilever beams. It is also an advantage of embodiments of the present invention to provide a polygon building using lean edges, whose leanness is not affected by the use of cantilever beams at the top of the polyhedron shape to couple the polyhedron shaped building to the column. It is an additional advantage of some embodiments of the present invention that the aesthetical view of the polyhedron building is not affected by the need to use more coarse edges in order to be able to provide a self supporting polyhedron building.

It is an advantage of some of the embodiments of the present invention to provide a building construction with a scientifically high volume/outer surface ratio. It is as well an advantage of some embodiments of the present invention to provide a polyhedron shape column borne building, which has reduced energy losses because of its high volume/outer surface ratio.

It is an advantage of some embodiments of the present invention to provide a polyhedron shape column borne buildings, which are equally or improved resistance to earthquakes. It is an advantage of some embodiments of the present invention to provide a column borne buildings, which can be raised in earthquake sensitive regions. It is an advantage of some embodiments of the present invention to provide a polyhedron shape column borne buildings, which have equally or improved resistance to flooding. It is an advantage of some embodiments of the present invention to provide a column borne building, which can be constructed and safely used in flooding sensitive regions.

It is an advantage of some embodiments of the present invention to provide polyhedron shaped buildings, which can be protected from excessive incident sunlight throughout the day. It is an advantage of some embodiments of the present invention to provide polyhedron shaped buildings which can be provided with electrical power throughout the whole year in an energy efficient way.

The above objective is accomplished by a column borne building construction according to the present invention.

A column borne building construction according to the first aspect of the present invention comprises a building and one substantially vertical column for bearing the load of said building construction. The building has a polyhedron shape, this polyhedron shape having a top face defining a polygon shape by means of N1 top edges and N1 top vertices. The polyhedron shape comprises additional faces other than said top face, which additional faces are defined by additional edges and additional vertices. The top face is substantially perpendicular to the column and encircling the column. Each of the N1 top vertices joins two top edges and at least one additional edge of the polyhedron. The column has a top coupling point and at least 3 of the N1 top vertices are connected to the column by means of a tension member. The extensions of these tension members coincide in the top coupling point.

According to some embodiments of the present invention, all N1 top vertices may be connected to the top coupling point by means of a tension member, the extensions of all of the N1 tension members coinciding in the top coupling point.

According to some embodiments of the present invention, for each tension member, the extension of the tension member may be substantially coplanar with at least one additional face comprising the at least one additional edge coupled to the top vertex, which vertex is connected to the column by means of the tension member. According to some embodiments of the present invention, the tension members may be substantially in line with the at least one additional edge.

According to some embodiments of the present invention, one of the additional face is a bottom face defining a polygon shape by means of N2 bottom edges and N2 bottom vertices. The bottom face is substantially perpendicular to the column and encircling the column. Each of the N2 bottom vertices joins two bottom edges and at least one additional edge of the polyhedron which at least one additional edge not being a bottom edge. The column may have a bottom coupling point and at least 3 of the N2 bottom vertices are connected to the column by means of a compression member of which the extensions of these compression members coincide in the bottom coupling point.

According to a second aspect of the present invention, a column borne building construction comprises a building and one substantially vertical column for bearing the load of said building construction. The building has a polyhedron shape having a bottom face defining a polygon shape by means of N2 bottom edges and N2 bottom vertices The bottom face is substantially perpendicular to the column and encircling the column. The polyhedron shape comprises additional faces other than the bottom face, which additional faces are defined by additional edges and additional vertices. Each of the N2 bottom vertices join two bottom edges and at least one additional edge of the polyhedron. The column has a bottom coupling point, at least 3 of the N2 bottom vertices are connected to the column by means of a compression member which extensions of the compression members coincide in the bottom coupling point.

According to some embodiments of the present invention, all N2 bottom vertices may be connected to the bottom coupling point by means of a compression member, the extensions of all of the N2 compression members coincide in the bottom coupling point.

According to some embodiments of the present invention, for each compression member, the extension of the compression member is substantially coplanar with at least one additional face comprising the at least one additional edge coupled to this bottom vertex, which bottom vertex is connected to the column by means of the compression member. According to some embodiments of the present invention, the compression members may be substantially in line with the at least one additional edge.

According to some embodiments, the polyhedron shape further has a top face defining a polygon shape by means of N1 top edges and N1 top vertices. The polyhedron shape comprises additional faces other than said top face, which additional faces are defined by additional edges and additional vertices. The top face is substantially perpendicular to the column and encircling the column. Each of the N1 top vertices join two top edges and at least one additional edge of the polyhedron. The column has a top coupling point and at least 3 of the N1 top vertices are connected to the column by means of a tension member. The extensions of these tension members coincide in the top coupling point. According to some embodiments of the present invention, all N1 top vertices may be connected to the top coupling point by means of a tension member, the extensions of all of the N1 tension members coinciding in the top coupling point. According to some embodiments of the present invention, for each tension member, the extension of the tension member may be substantially coplanar with at least one additional face comprising the at least one additional edge coupled to the top vertex, which vertex is connected to the column by means of the tension member. According to some embodiments of the present invention, the tension members may be substantially in line with the at least one additional edge.

According to some of the embodiments of the building construction, the complete load of the building is borne by the substantially vertical column. The building construction is coupled to the ground by means of this one vertical column which transfers the load of the building and the column to the ground surface on which the building construction is raised.

According to some embodiments of the present invention, the polyhedron may be a convex polyhedron. The polyhedron may be a geodesic shape. According to some embodiments of the present invention, said polyhedron may have a fullerene shape. According to some embodiments of the present invention, each face of the fullerene shape may be the base of a M-sided pyramid comprising M equal triangular walls, meeting at an apex being oriented outwards the polyhedron.

According to some embodiments of the present invention, the vertices may be points located on the surface of an imaginary sphere or imaginary ellipsoid. According to some embodiments of the present invention, the apexes may be points located on the surface of the imaginary sphere or imaginary ellipsoid.

According to some embodiments of the present invention, the building construction may further comprise a terrace coupled to the outer surface of the building. According to some embodiments of the present invention, the terrace may be located at substantially half the height of the building. The terrace may be substantially ring-shaped and encircles the column.

According to some embodiments of the present invention, the building construction may comprise means for axially moving the building along the column.

According to some embodiments of the present invention, the building construction may comprises at least a section of a spherical lune, which spherical lune having a radius RI larger than the radius of an imaginary ball Rb being the smallest imaginary ball which encompasses the building. the spherical tune may extend from a point of the column extending beyond the top coupling point, downwards towards the bottom coupling point, along the outer surface of the polyhedron. the spherical lune may be rotatably mounted on the column. According to some embodiments of the present invention, the at least a section of a spherical lune may be a half of a spherical lune. According to some embodiments of the present invention, the section of a spherical lune may be provided with at least one solar cell. According to some embodiments of the present invention, the at least one solar cell may be rotatably mounted around an axis of rotation, which axis of rotation may be substantially perpendicular to the column.

According to a third aspect of the present invention, a method of fabricating a column borne building construction is provided. The method comprises constructing a building and one substantially vertical column for bearing the load of the building construction. The building has a polyhedron shape, which polyhedron shape has a top face defining a polygon shape by means of N1 top edges and N1 top vertices. The polyhedron shape comprises additional faces other than the top face, which additional faces are defined by additional edges and additional vertices. The top face is substantially perpendicular to the column and encircling the column. Each of the N1 top vertices join two top edges and at least one additional edge of the polyhedron. The column has a top coupling point, at least 3 of the N1 top vertices are connected to the column by means of a tension member which extensions of the tension members coincide in the top coupling point.

According to embodiments, one of the additional faces is a bottom face defining a polygon shape by means of N2 bottom edges and N2 bottom vertices. The bottom face is substantially perpendicular to the column and encircling the column. Each of the N2 bottom vertices join two bottom edges and at least one additional edge of said polyhedron which at least one additional edge is not a bottom edge. The column has a bottom coupling point and at least 3 of the N2 bottom vertices are connected to the column by means of a compression member, for which the extensions of the compression members coincide in the bottom coupling point.

According to a third aspect of the present invention, a method of fabricating a column borne building construction is provided. The method comprises constructing a building and one substantially vertical column for bearing the load of said building construction. The building has a polyhedron shape having a bottom face defining a polygon shape by means of N2 bottom edges and N2 bottom vertices. The bottom face is substantially perpendicular to the column and encircling the column. The polyhedron shape comprises additional faces other than the bottom face. The additional faces are defined by additional edges and additional vertices. Each of the N2 bottom vertices joins two bottom edges and at least one additional edge of the polyhedron. The column has a bottom coupling point and at least 3 of the N2 bottom vertices are connected to the column by means of a compression member, which extensions of the compression members coincide in the bottom coupling point.

Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable and reliable devices of this nature.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DESCRIPTION OF ILLUSTRATIVE EMBODIMENTS

Figure 1:
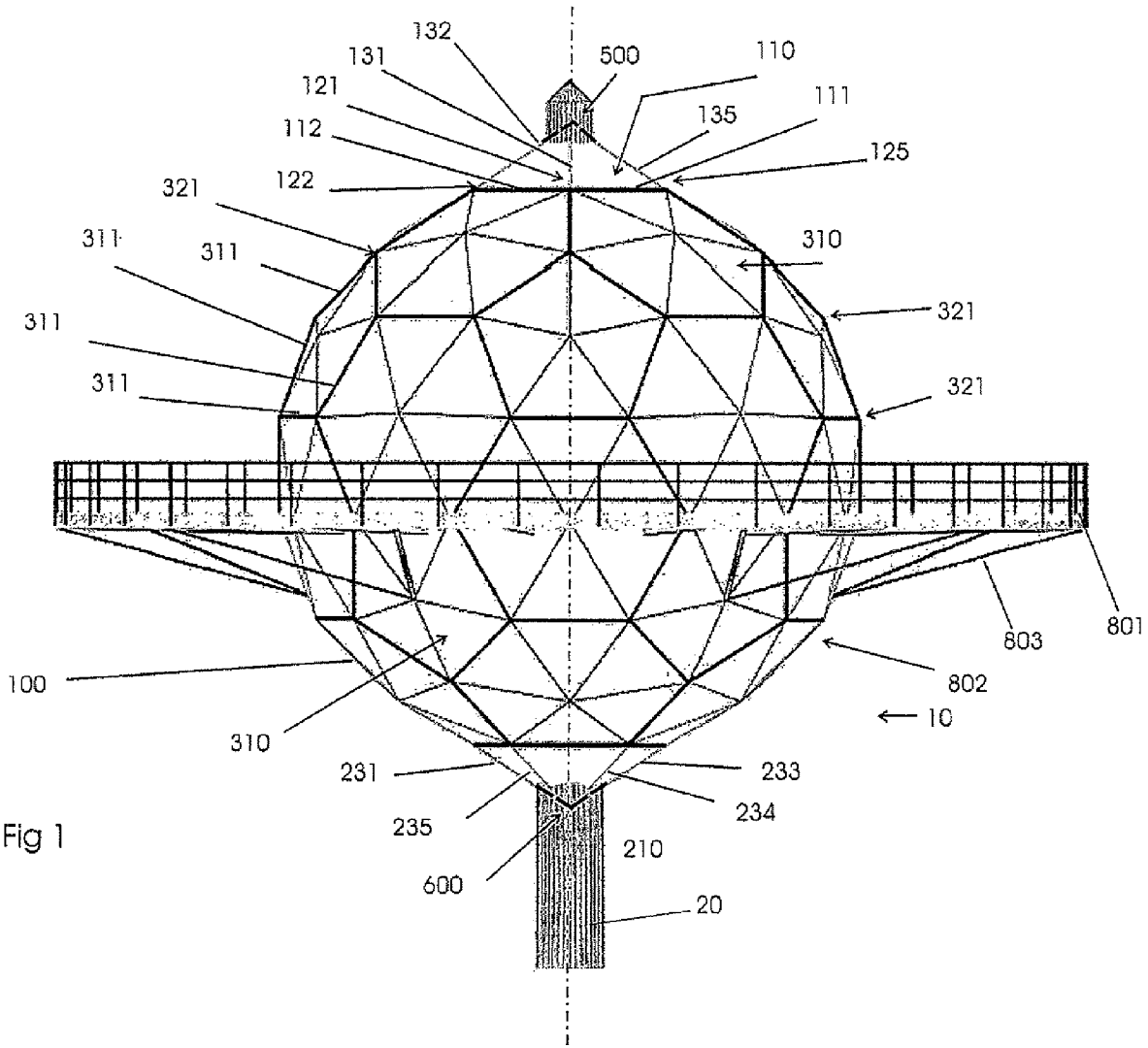
FIG. 1 is a schematically side view of a column borne building construction as subject of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein may be capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The following terms are provided solely to aid in the understanding of the invention. These definitions should not be construed to have a scope less than understood by a person of ordinary skill in the art.

The term "building" is to be understood as any man-made structure used or intended for supporting or sheltering any use or continuous occupancy.

The term 'tension member' is to be understood as an element of a building construction, which is subjected substantially only to tension forces during use in the construction.

The term 'compression member' is to be understood as an element of a building construction, which is subjected substantially only to compression forces during use in the construction.

For both tension members and compression members, forces other than tension or compression as the case may be, may be experienced by the tension member or compression member because of e.g. imperfections of the construction or construction tolerances.

The term 'column' is to be understood as a supporting pillar, which may be coupled to earth or ground by means of e.g. a foundation on which the column is based, or which is e.g. driven into the ground like a pile, or which is coupled to ground by means of e.g. a combination of both.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

Other arrangements for accomplishing the objectives of the column borne building construction, embodying the invention will be obvious for those skilled in the art.

Figure 2:
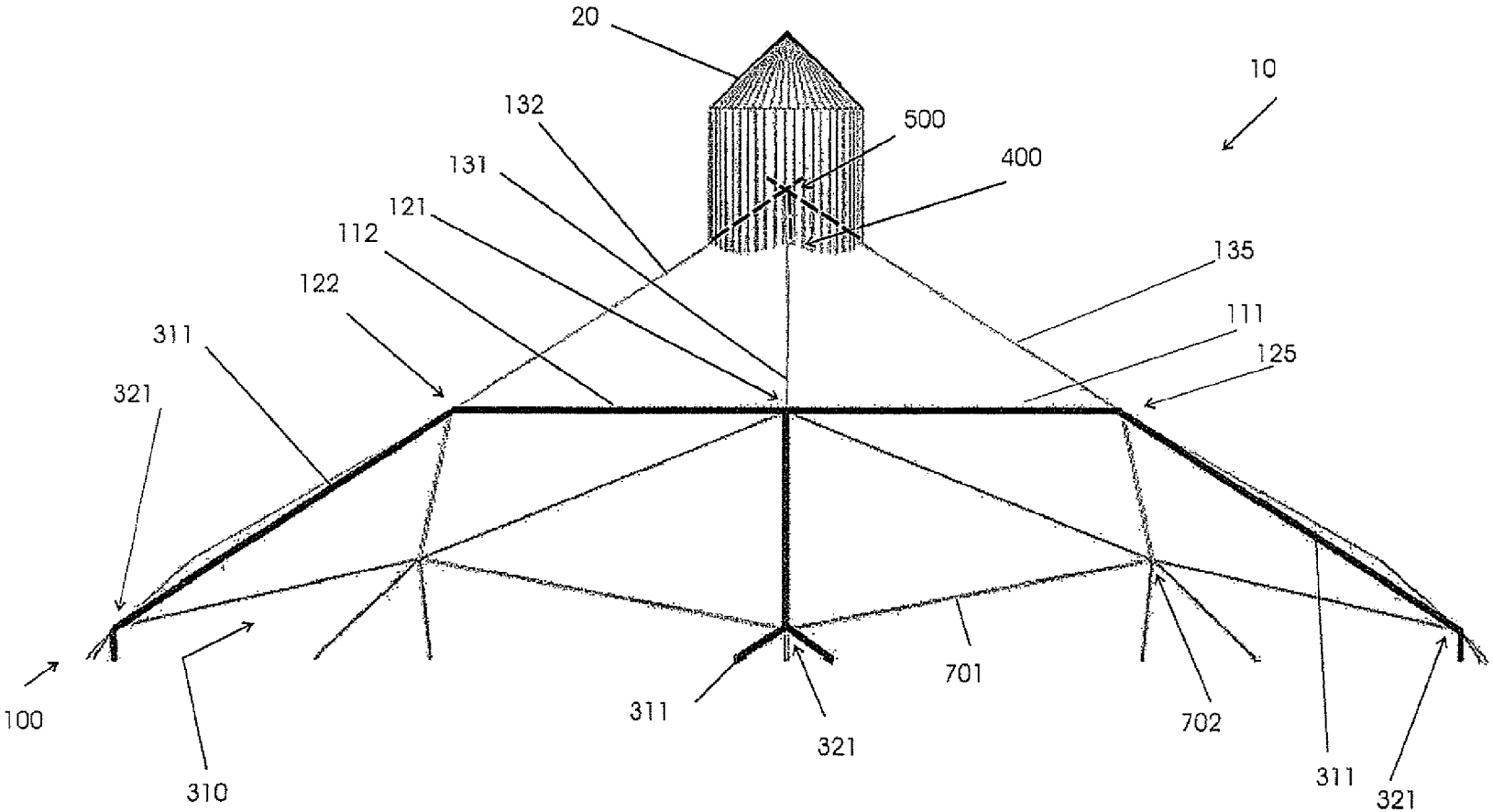
FIG. 2 is a schematically detail of the top of the column borne building construction if FIG. 1.
Figure 3:
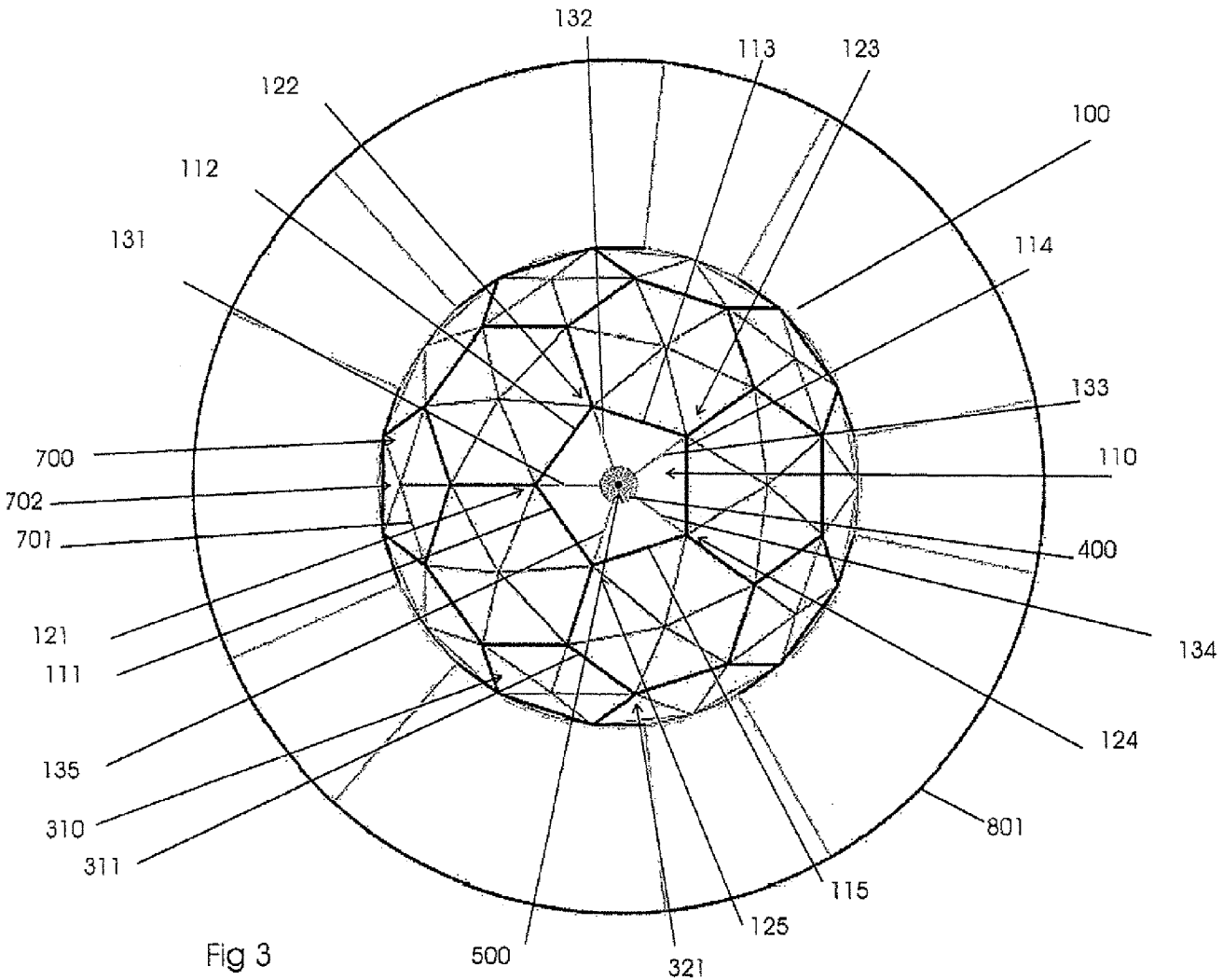
FIG. 3 a schematically top view of the column borne building construction as subject of the present invention of FIG. 1.
Figure 4:
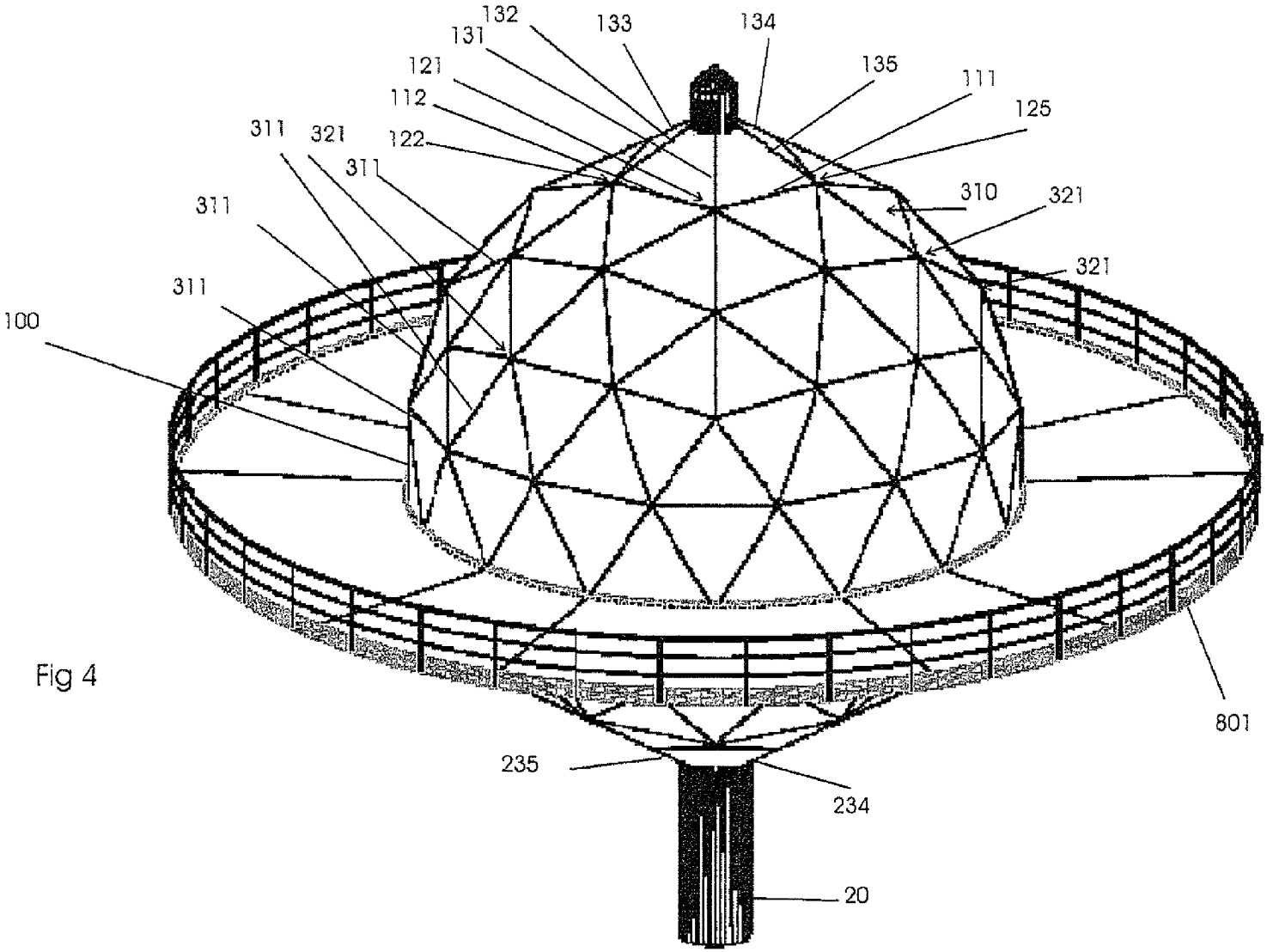
FIG. 4 is a schematically perspective view of the column borne building construction as subject of the present invention of FIG. 1.

A first embodiment of a column borne building construction 10 of the present invention is shown in FIG. 1, FIG. 2, FIG. 3 and FIG. 4. FIG. 1 is a side view of the building construction 10, FIG. 2 is a detail of the top part of the building construction 10, whereas FIG. 3 is a top view of the building construction 10. FIG. 4 is a perspective view of the building construction 10. A polyhedron shape building 100 is provided, being borne by one, substantially vertical central column 20. This column 20 is supported at ground level on an appropriate foundation, e.g. a concrete foundation. The polyhedron shape building 100 is defined by means of vertices, edges and faces. The polygons, which make up the polyhedron may be triangle, squares, pentagons, hexagons, etc. although "locked structures" may be preferred. A "locked structure" is one where the polygon cannot be deformed by mere rotation of the apices of the polygon. Thus a square is not a locked structure but a triangle is. In one particular embodiment the building has a fullerene shape comprising several hexagonal and pentagonal faces. The polyhedron has a substantially horizontal top face 110, being a pentagonal shaped surface having five top edges 111 , 112, 112, 114 and 115, which edges meet, two by two, in five top vertices 121, 122, 123, 124 and 125. The polyhedron shape further comprises further faces 210, 310, one of which is in this particular case a substantially horizontal bottom face 210, the other being referred to as additional faces 310. In the embodiment of a building construction 10, the bottom face is also a pentagonal face being defined by five bottom edges 211, 212, 213, 214 and 215 and five bottom vertices 221, 222, 223, 224 and 225. Each of the additional faces 310, having either a pentagonal or a hexagonal shape, is defined by means of several additional edges 311 and several additional vertices 321, optionally, together with top or bottom edges and vertices when the additional face has an edge in common with either the bottom face or the top face.

It is clear that the top face 110 and the bottom face 210 are both substantially perpendicular to the column 20 and encircling this column 20, more particular the column coincide with the central points 400 of the pentagonal shape of the bottom face and the top face.

In each of the top vertices, two top edges are joined to at least one additional edge of an additional face, i.e. an edge which is not a top edge. According to the invention, at least 3, and in this particular case all top vertices, i.e. the five top vertices, are coupled to the column 20 by means of a tension member 131, 132, 133, 134 and 135. The tension members are provided in such a way that the extensions of the tension members coincide in one point, which is positioned in the column 20, i.e. the top coupling point 500. The tension members are only subjected to tension forces. The tension members are for transferring the forces induced by the weight of the building 100 by tension forces only in the tension members. The tension members are provided in such a way that the forces induced by the weight of the building 100, are transferred to the column only by a tension force in the tension member. The forces induced by the weight of the building 100 do not cause a momentum of force acting on the tension member.

Because all tension members are to coincide in one point, the moment, which is induced to the column by these tension members is limited or even brought to zero. In order to have the best effect, the top vertices being coupled to the column by means of a tension member are radially equally distributed around the column.

More preferred, as shown in FIG. 1, the extension of the tension member is substantially coplanar with at least one additional face of which the additional edge, coupled in this top vertex, is part. Most preferred, the extension of the tension member substantially coincides with the additional edge which is joined to the two top edges at the top vertex being coupled to the column by this tension member. This alignment of the extension of the tension member and the at least on additional edge has the advantage that the forces acting in the additional edge are identical to the tension forces acting in the tension member. The tension member does not have to be provided more resistant to tension as the additional edge itself, nor has it to be provided out of more strong material. The provision of this alignment thus has the effect that the additional edges and the tension members may be provided from identical material and may have an identical outlook, which is advantageous from an esthetical point of view. Further, the use of additional material is avoided, as no additional material has to be provided to meet larger tensional resistance properties of the tension members as compared to the additional edges, hence the alignment may make the tension members leaner.

In a similar way, in each of the bottom vertices, two bottom edges are joined to at least one additional edge of an additional face, i.e. an edge which is not a top edge, nor a bottom edge. At least 3, and in this particular case all bottom vertices, i.e. the five bottom vertices, are coupled to the column 20 by means of a compression member 231, 232, 233, 234 and 235. The compression members are provided in such a way that the extensions of the compression members coincide in one point, which is positioned in the column 20, i.e. the bottom coupling point 600. The compression members are only subjected to compression forces. The compression members are for transferring the forces induced by the weight of the building 100 by compression forces only in the compression members. The compression members are provided in such a way that the forces induced by the weight of the building 100, are transferred to the column only by a compression force in the member, The forces induced by the weight of the building 100 do not cause a momentum of force acting on the compression member.

Because all compression members are to coincide in one point, the moment, which is induced to the column by these compression members is limited or even brought to zero. In order to have the best effect, the bottom vertices being coupled to the column by means of a compression member are radially equally distributed around the column.

More preferred, as shown in FIG. 1, the extension of the compression member is substantially coplanar with at least one additional face of which the additional edge, coupled in this bottom vertex, is part. Most preferred, the extension of the compression member substantially coincides with the additional edge, which is joined to the two bottom edges at the bottom vertex being coupled to the column by this compression member. This alignment of the extension of the compression member and the at least on additional edge has the advantage that the forces acting in the additional edge are identical to the compression forces acting in the compression member. The compression member does not have to be provided more resistant to compression as the additional edge itself, nor has it to be provided out of more strong material. The provision of this alignment thus has the effect that the additional edges and the compression members may be provided from identical material and may have an identical outlook, which is advantageous from an esthetical point of view. Further, the use of additional material is avoided as no additional material has to be provided to meet larger compression resistance properties of the compression members as compared to the additional edges. The alignment may even make the compression members leaner.

As far as the compression members are concerned, also the risk on buckling under compression force is to be taken into account. In order to find the optimum between amount of material in order to withstand the compression force and the length of the compression member, which is preferably to be kept minimum, to avoid buckling out, the angle between compression member and the horizontal plane is preferably in the range of 30 to 60°, more preferably about 45°.

The provision of the tension members and/or the compression members being coplanar with at least one additional face or even the alignment of the tension members and/or the compression members with the extension of the additional edge, provides the most efficient use of the strength of the material of the tension members and/or the compression members, and the edged coupled to the tension members and/or the compression members at the vertices. When the tension members and/or the compression members are coupled to the column at an angle with the columns axis being larger than the angel between extension of the additional edge and the columns axis, additional tension or compression forces may be created in the additional edges.

When the compression members are coupled to the column at an angle with the columns axis being smaller than the angle between extension of the additional edge and the columns axis, additional material is to be used in the compression member in order to avoid buckling of the compression member.

The tension members and the compression members may be provided from metal alloys such as construction steel, aluminium, stainless steel, or from wood, composite material, e.g. reinforced polymer material such as glass fiber or carbon fiber reinforced thermoplastic or glass fiber or carbon fiber reinforced thermoset material. The cross-sectional profile of the tension and/or compression members may be selected in function of the tension or compression force to be withstood, including applicable safety margins.

By using compression and tension members, the amount of material to be used to provide these compression and tension member, and hence the building can be reduced. The large volume of material, which would be necessary when cantilever beams are used for providing support and coupling of the building to the column, is avoided. Because the tension members and compression members substantially only use tension or compression forces to couple the weight of the building to the column, a more efficient use of the strength of the material establishing this coupling is provided. Hence the building, and thus the building construction obtains a leaner outlook as less material is necessary to provide the coupling of the building to the column.

In order to obtain a well-balanced building construction, the angle between axis of the column and the tension members is preferably substantially identical with the angle between axis of the column and the compression members.

The top face and the bottom face, which is to provide a ceiling and/or a floor level, may be provided as a self supporting plate which has an aperture fitting around said column 20, or may be constructed using radially extending beams, which beams are joined at one side, i.e. their inner side, to the column 20, and at their other, outer side to one of the top vertices or the bottom vertices These beams can be provided using less material, as they have to resist only the bending moments due to their own weight and the products, which they have to support when functioning a floor and/or ceiling.

The inner side of the building can provided by additional intermediate levels or floors. This by e.g. coupling a group of vertices, which are located at substantially the same height along the column, to this column by means of radially extending floor beams. Again, these beams are only to be resistant to bending moments, caused by their own weight and the load they are to be able to carry at this floor. Therefore, as they do not take part in the construction of the outer surface of the building 10, these beams can be provided using a minimum of material.

Radially extending beams for providing top or bottom or other beams for providing intermediate levels and floors are preferably connected to the vertices of the polyhedron itself, as such couplings reduces or even avoids the beams and the edges of the polyhedron to be subjected to forces, other than tension or compression forces.

The coupling of edges, being top edges, bottom edges or additional edges at the vertices of the polyhedron may be a moment transferring coupling, but preferably are provided using hinges, such as using ball joints, transferring less or even no moment.

The edges, i.e. the top edges, bottom edges and additional edges may be construction elements made out of metal alloys, such as construction steel, aluminium, stainless steel, or from wood, composite material, e.g. reinforced polymer material such as glass fiber or carbon fiber reinforced thermoplastic or glass fiber or carbon fiber reinforced thermoset material. All such materials may be used as well for the tension members and the compression members.

The construction elements such as tension members, compression members and construction elements providing the additional edges are preferably substantially straight construction elements, e.g. profiled construction elements such as construction beams.

In order to facilitate the entrance to the building 100 of the building construction, a means to enter the building, like a stair, is provided, together with one of the faces of the polyhedron, which serves as entrance, e.g. being a door or gate, e.g. a roll-up door or roll-up shutter. The other faces, either the faces of the polyhedron shape or the triangular sides of the pyramids in case the polyhedrons faces serve as a base of a pyramid, may be provided out of many different possible materials, such as e.g. glass, e.g. coloured, reflective, transparent, semi-transparent or electro-transparent glass, steel, wood, plastic being transparent, semitransparent or light impermeable, or they may be provided out of solar cells. Some of the faces may be provided as door or window or provided with many other functional elements of a building.

Turning to the polyhedron shape of the building. Polyhedron shapes having a top face 110 and bottom face 210 being substantially perpendicular to the substantially vertical column 20 are preferred. This because it facilitates the provision of a substantially horizontal roof and a substantially horizontal floor layer, as well as substantially horizontal intermediate levels or floors. The polyhedron shape is preferably a convex polyhedron shape. More preferred, the vertices of the building, being top vertices, bottom vertices and additional vertices, preferably are located in 3D on the surface of an imaginary sphere or an oblate or prolate ellipsoid. Optionally, polyhedrons can be used having a top and optionally, a bottom surface substantially perpendicular to the column, i.e. top and bottom face being substantially horizontal, which polyhedrons are vertex-uniform, edge-uniform and/or face uniform. As an example the polyhedron may be a truncated icosahedron, better known as bucky ball, of which the edges are either under tension or compression. Other possible alternatives are rhombicuboctahedrons, truncated dodecahedron, truncated icosidodecahedron, rhombicosidodecahedron or similar shapes. The polyhedron has preferably a geodesic shape, of which the edges are under substantially only tension or compression.

As shown in FIG. 1 to FIG. 4, in order to have the outer building shape approximating even more the shape of an imaginary sphere, or ellipsoid, the top face 110, bottom face 120 and/or any other face 130 of the polyhedron shape may each serve as a base of a pyramid 700. In the embodiment of FIG. 1 to FIG. 4, the pyramids are hexagonal and pentagonal pyramids, which pyramids have pyramid ribs 701 meeting at the pyramids apex 702. Most preferred, the apexes are located in 3D on the surface of an imaginary sphere or an oblate or prolate ellipsoid, most preferred on the same imaginary sphere or an oblate or prolate ellipsoid on which the vertices of the polyhedron are located.

The coupling of ribs to each other at the apexes or to edges, at the vertices of the polyhedron may be a moment transferring coupling, but preferably are provided using hinges, such as using ball joints.

The column may as well be provided with functional elements. As an example, the column may be a hollow tubular construction, whose interior void is used to provide cables or conducts of e.g. electrical power, potable water, waist water, gas, telecom and many more to of from the building, or which void is used as ventilation channel. The column may as well be used as an elevator shaft. The top of the column 20 may be provided with an antenna for capturing or sending EM-signals. The column may also be used as a support for a windmill or wind turbine, which windmill or wind turbine may be used to generate electrical power. The windmill or windturbine may be provided with a means to rotate around the axis of the column, to position the blades of the windmill or wind turbine in optimal orientation in relation to the direction of the wind. The advantage of the location of the windmill or wind turbine is that the underlying building construction always provide substantially an identical influence on the efficiency of the windmill or wind turbine. The power generated by the windmill or wind turbine is thus substantially independent of the wind direction.

The column may be provided as a tube, e.g. a steel tube, having an outer diameter of about 1.2 m and an inner diameter of about 1.15 m. The tube can have a height of about 16 m, for example.

The dimensions of the polyhedron shape can be chosen in such a way that the construction elements, i.e. the top edges, bottom edges additional edges and optionally, the side, pyramid ribs and the surfaces mounted between these constructive elements have a dimension which fits in a standard container. As an example, the polyhedron shape can be a fullerene shape or 'bucky ball'-shape as shown in FIG. 1 to FIG. 4, of which the smallest ball encompassing the shape has a diameter of Rb., e.g. being in a range of 4 to about 20 m. A building construction having only one floor is provided preferably by using a diameter in the range of 4 m to 6 m. A building construction having two levels or floors, one at half the height of the building construction, is preferably provided using a diameter of about 4 m to 8 m, such as 6 m, 7 m or 8 m. A building construction having three levels or floors, is preferably provided using a diameter of about 10 m to 12 m, such as 10 m, 11 m or 12 m. A building construction having four levels or floors, is preferably provided using a diameter of about 13 m to 16 m. The embodiment shown in FIG. 1 to FIG. 4 has a diameter Rb of about 11 m. Using this dimension, the top edges, bottom edges, additional edges and possible pyramid ribs have at maximum a length of 2.3 m. All such construction elements fit in a standard 40 ft container type. The column used has an outer diameter of about 1.2 m and in inner diameter of about 1.15 m. The edges and ribs are preferably provided from IPE 220 beams, whereas the beams to construct the floors are HEM 260 profiles. The breams to provide the terrace are HEM 180 profiles. All elements are made out of Steel 37-2.

As shown in FIG. 1 to FIG. 4, the building construction 10 comprises a building which is provided with a terrace 801 coupled to the outer surface 802 of the building, e.g. at the height of one of the intermediate floors of the building. This terrace can be provided by extending the beams of the intermediate floor beyond the vertices to which they are joined. Preferably the terrace is ring shaped, encircling the column 20. Alternatively, the terrace only is provided along a part of the outer surface of the polyhedron shaped building 10. Preferably, the terrace is located at substantially half the height of the building. The terrace 801 may further comprise small cantilever beams 803 to reduce the load which is transferred to the vertex.

According to the present invention, preferably the complete load of the building is or can be born by the one column. This is in particular advantageous in case the ground on which the building construction is to be raised, does not allow the provision of a larger ground surface of constructions to be provided. By selecting one small area where the ground is to support the column, the complete load of the building can be transferred to the ground via only this one column. The bearing of the load is done by using a minimum of construction material when using tension members or compression members, and preferably both tension members and compression members for connecting the top or bottom vertices, as the case may be, to the top or bottom coupling point of the column. This not only allows the provision of lean building constructions, but also causes the mechanical properties of the construction elements such as tension members and/or compression members to be used most efficiently.

Figure 5:
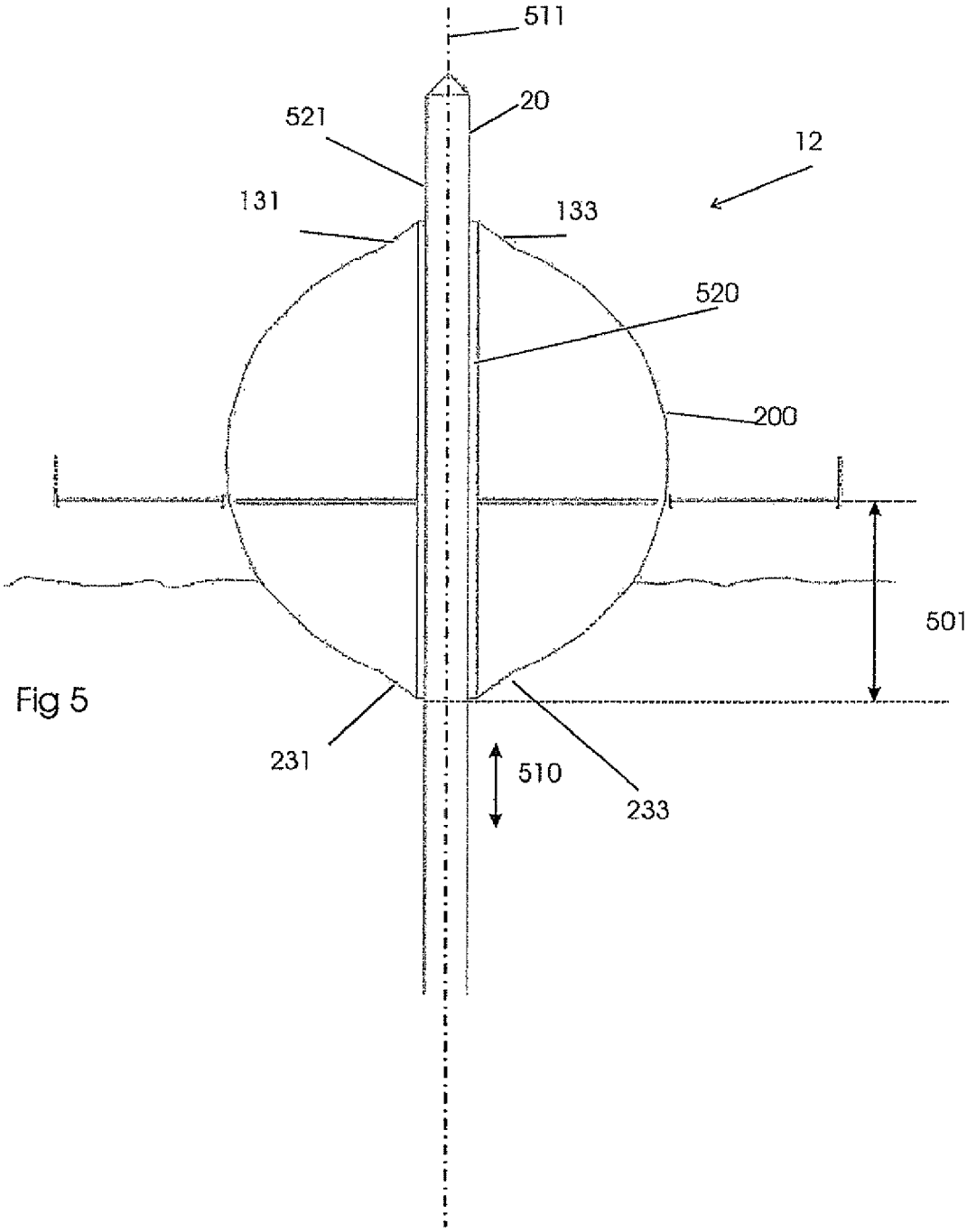
FIG. 5 and FIG. 6 are schematically views of alternative column borne building construction as subject of the present invention In the different figures, the same reference signs refer to the same or analogous elements.

In an other alternative pile borne building construction 12, as schematically shown in FIG. 5, at least the lower section 501 of the polyhedron shaped building 102 (of which only the contour is shown) can be provided in a liquid tight way, allowing the polyhedron shaped building to float. Optionally, the building is coupled to the column in such a way that the building can axially move in vertical direction (as indicated with reference 510), i.e. along the axis 511 of the column. As an example, the column 20 may comprise a first tube 520 axially moveable and optionally rotatably mounted around a second tube 521. Advantageously when having these two features combined, the building construction may be provided in a region where a high risk on flooding exist, or in regions which are permanently flooded. The column borne building construction may avoid contact of the building with water when the water is not present or when the water is present at a low level. When the water level rises, or when the region gets flooded, the water may contact the lower side of the polyhedron shaped building and lifts the building upwards, while the building floats on the water surface. Once the water level falls, the building will be moved along downwards until the building is prevented to further move downwards.

It is understood that the axially moveable building may permanently float on a water surface, e.g. a sea or lake The column may partially bear the load of the building, and will function as an anchor to secure the position of the building construction in horizontal direction.

Figure 6:
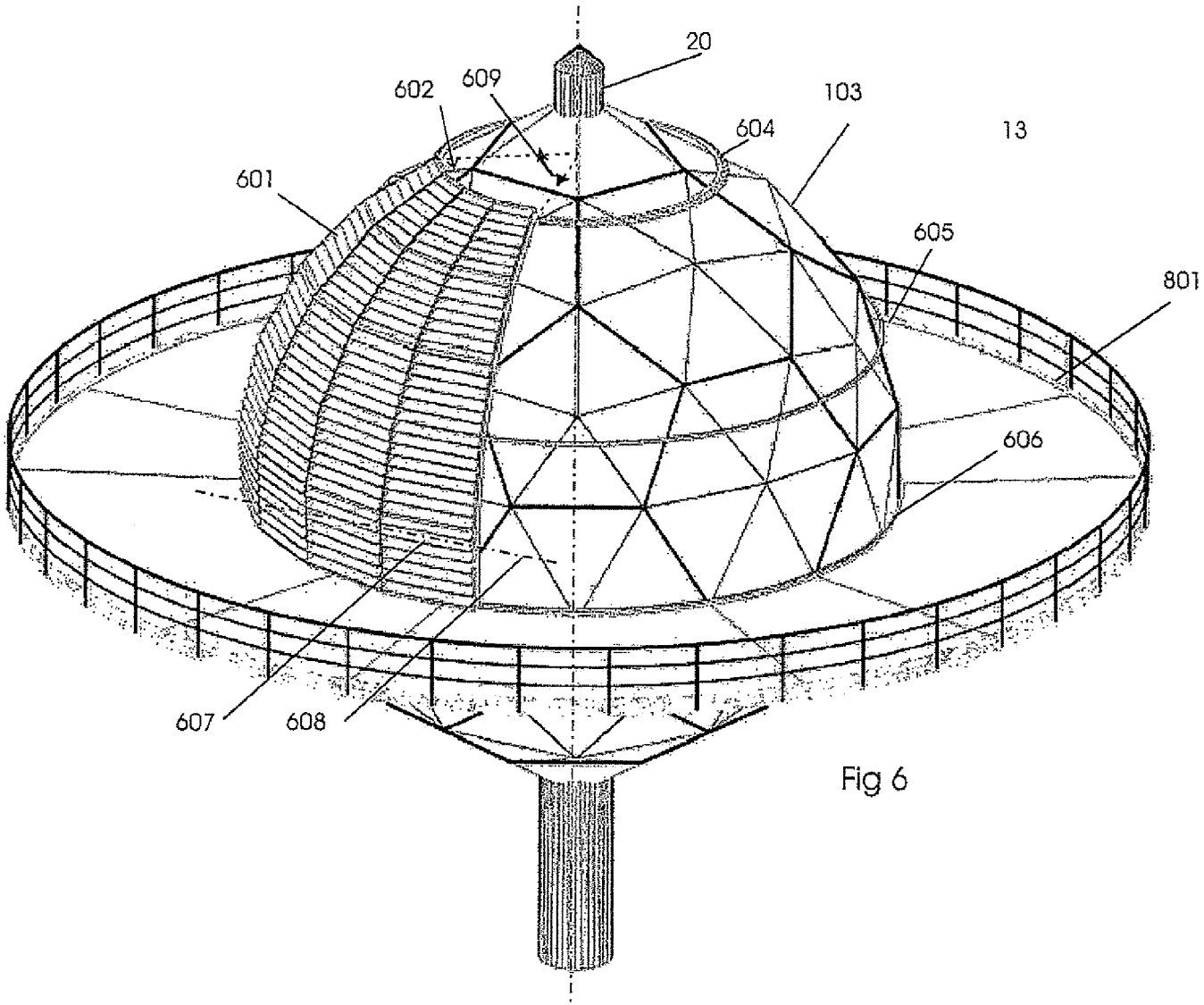

As shown in FIG. 6, the embodiment of a building construction 13 comprises a polyhedral shaped building 103 being substantially identical as the polyhedron shaped building 100 of FIG. 1 to FIG. 4, and comprising a terrace 801. The building construction further comprises at least a section of a spherical lune 601, which spherical lune has a radius RI. A lune is plane figure bound by two circular arcs of unequal radius, e.g. a crescent. A spherical lune is a sliver of the surface of a sphere of radius R cut out by two planes through the azimuthal axis with a dihedral angle. RI is larger than the radius Rb of the smallest imaginary ball which completely encompasses the building 103. The spherical lune extends from a point 602 of the building, downwards towards the bottom coupling point along the outer surface of the polyhedron. The spherical lune is rotatably mounted on the column. The section of a spherical lune, being half a spherical lune in this embodiment, may serve as a solar shield, preventing a too large amount of solar light to enter the interior 603 of the building. The spherical lune can be rotated around the building to orient the lune towards the sun. This to provide most efficient shielding of the building part subjected to incident sunlight at each moment of the day.

To rotate the spherical lune, appropriate means for rotating the lune are to be provided, e.g. an electrical motor and a coupling of the motor to the lune. In the embodiment according to FIG. 6, the lune may be supported on the terrace by means of rails 604, 605 and 606, guiding the lune at its lower side. It is understood that optionally, a means to calculate the optimum orientation of the lune, i.e. the optimum position in radial position around the column, may be provided.

As shown in FIG. 6, the lune is provided with a number of solar cells 607 which solar cells are rotatably mounted around a substantially horizontal axis 608, i.e. an axis being substantially perpendicular to the column. The inclination of each of the solar cells can be adjusted according to the height of the sun at that particular moment in time. As an example, at noon, the solar cells may be inclined to a more horizontal position, whereas at sun rise or sun perdition, the solar cells will be in a more vertical position. This in order to obtain sun ray inclination on the solar cell at an angle being as close as possible to 90°.

It is understood that dependent on the requirements, the dihedral angle 609 of the lune can be varied according to the needs and circumstances.

It is understood that the building construction according to the invention can be used for many purposes, e.g. as a house, restaurant, office, theatre, and many more.

It is to be understood that although preferred embodiments, specific constructions and configurations, as well as materials, have been discussed herein for devices according to the present invention, various changes or modifications in form and detail may be made without departing from the scope and spirit of this invention. For example, two or more such constructions can be provided adjacent to each other, and having one face of the polyhedrons in common. In such a way, the benefit of transferring the load of the buildings to the column via tension members, and optionally, via compression members, can be combined with increased interior volume of two or more combined buildings. As an example, five building constructions can be provided, each of the five buildings being arranged at a corner of an imaginary pentagon, and each of the buildings being coupled to its two adjacent building constructions. The area between the five building constructions at the inner side of the imaginary pentagon can be provided as a terrace, coupled to the five building constructions and being provided with a central elevator unit.

It is also clear that one column may be provided with two or more buildings, each building being coupled to the column using tension members and possible compression members.

As another example, the column may be of uniform width, or its preferably substantially circular cross section may change in diameter, i.e. decreasing upwards. The diameter may decrease stepwise or continuously.

The invention claimed is:

1. A column borne building construction comprising a building and one substantially vertical column for bearing the load of said building construction, said building having a polyhedron shape, the polyhedron shape being a fullerene shape, said polyhedron shape having a substantially horizontal top face defining a polygon shape by means of a first number top edges and an equal first number of top vertices, said polyhedron shape comprising additional faces other than said top face, said additional faces being defined by additional edges and additional vertices, said top face being substantially perpendicular to said column and encircling said column, wherein said column coincides with a central point of said top face, each of said first number of top vertices joining two top edges and at least one additional edge of said polyhedron, said top edges and said additional edges comprising construction elements, said column having a top coupling point, at least 3 of said first number of top vertices being connected to said column by means of a tension member comprising a further construction element, wherein extensions of said tension members coincide at said top coupling point, wherein for each tension member the extension of said tension member lies in a common plane with at least one additional face comprising said at least one additional edge coupled to said top vertex connected to said column by means of said tension member, and wherein an angle between each of said tension members and said substantially horizontal top face is in the range of 30 to 60 degrees.

2. A building construction according to claim 1, wherein all of said first number of top vertices are connected to said top coupling point by means of a tension member comprising a further construction element, the extensions of all of said first number of tension members coinciding at said top coupling point.

3. A building construction according to claim 1, wherein said tension members are substantially in line with said at least one additional edge.

4. A building construction according to claim 1, wherein one of said additional face is a substantially horizontal bottom face defining a polygon shape by means of a second number of bottom edges and an equal second number of bottom vertices, said bottom face being substantially perpendicular to said column and encircling said column, wherein said column coincides with a central point of said bottom face, each of said second number of bottom vertices joining two bottom edges and at least one additional edge of said polyhedron, said at least one additional edge not being a bottom edge, said column having a bottom coupling point, at least 3 of said second number of bottom vertices being connected to said column by means of a compression member comprising a further construction element, the extensions of said compression members coinciding at said bottom coupling point, and wherein an angle between each of said compression members and said substantially horizontal bottom face is in the range of about 30 to 60 degrees.

5. A building construction according to claim 4, wherein for each compression member the extension of said compression member lies in a common plane with at least one additional face comprising said at least one additional edge coupled to said bottom vertex connected to said column by means of said compression member.

6. A building construction according to claim 4, wherein the connection between the bottom vertices and the column comprises a compression member subjected to compression forces and not to a moment force.

7. A column borne building construction comprising a building and one substantially vertical column for bearing the load of said building construction, said building having a truncated icosahedron shape, said truncated icosahedron shape having a substantially horizontal bottom face defining a pentagonal shape by means of five bottom edges and five bottom vertices, said bottom face being substantially perpendicular to said column and encircling said column, wherein said column coincides with a central point of said bottom face, said truncated icosahedron shape comprising additional faces other than said bottom face, said additional faces being defined by additional edges and additional vertices, each of said five bottom vertices joining two bottom edges and at least one additional edge of said truncated icosahedron, said bottom edges and said additional edges comprising construction elements, said column having a bottom coupling point, at least 3 of said five bottom vertices being connected to said column by means of a compression member comprising a further construction element, the extensions of said compression members coinciding at said bottom coupling point, wherein for each compression member the extension of said compression member lies in a common plane with at least one additional face comprising said at least one additional edge coupled to said bottom vertex connected to said column by means of said compression member, and wherein an angle between each of said compression members and said substantially horizontal bottom face is about 45 degrees.

8. A building construction according to claim 1, wherein the connection between the top vertices and the column is by means of a tension member subjected to tension forces and not to a moment force.

9. A building construction according to claim 1 or 7, wherein said building construction comprises at least a section of a spherical lune, said spherical lune having a radius (RI) larger than a radius of an imaginary ball (Rb) that is the smallest imaginary ball which encompasses the building, said spherical lune extending from a point along the column extending beyond said top coupling point, downwards towards said bottom coupling point along the outer surface of said polyhedron, said spherical lune being rotatably mounted on said column.

10. A building construction according to claim 7, wherein one of said additional faces is a substantially horizontal top face defining a pentagonal shape by means of five top edges and five top vertices, said top face being substantially perpendicular to said column and encircling said column, wherein said column coincides with a central point of said top face, each of said five top vertices joining two top edges and at least one additional edge of said truncated icosahedron, said at least one additional edge not being a top edge, said column having a top coupling point, at least 3 of said five top vertices being connected to said column by means of a tension member comprising a further construction element, the extensions of said tension members coinciding at a top coupling point, and wherein an angle between each of said tension members and said substantially horizontal top face is about 45 degrees.

11. A building construction according to claim 10, wherein all five top vertices are connected to said top coupling point by means of a tension member comprising a further construction element, the extensions of all of said five tension members coinciding at said top coupling point.

12. A building construction according to claim 10, wherein the connection between the top vertices and the column is by means of a tension member subjected to tension forces and not to a moment force.

13. A building construction according to claim 7, wherein all five bottom vertices are connected to said bottom coupling point by means of a compression member comprising a further construction element, the extensions of all of said five compression members coinciding at said bottom coupling point.

14. A building construction according to claim 7, wherein said compression members are substantially in line with said at least one additional edge.

15. A building construction according to claim 7, wherein the connection between the bottom vertices and the column is by means of a compression member subjected to compression forces and not to a moment force.

16. A method of fabricating a column borne building construction comprising: constructing a building and one substantially vertical column for bearing the load of said building construction, said building having a polyhedron shape, said polyhedron shape being a fullerene shape, said polyhedron shape having a substantially horizontal top face defining a polygon shape by means of a first number of top edges and an equal first number of top vertices, said polyhedron shape comprising additional faces other than said top face, said additional faces being defined by additional edges and additional vertices, said top face being substantially perpendicular to said column and encircling said column, wherein said column coincides with a central point of said top face, each of said first number of top vertices joining two top edges and at least one additional edge of said polyhedron, said top edges and said additional edges comprising construction elements, said column having a top coupling point, at least 3 of said first number of top vertices being connected to said column by means of a tension member comprising a further construction element, the extensions of said tension members coinciding at said top coupling point, for each tension member, the extension of said tension member lying in a common plane with at least one additional face comprising said at least one additional edge coupled to said top vertex connected to said column by means of said tension member, and wherein an angle between each of said tension members and said substantially horizontal top face is in the range of 30 to 60 degrees.

17. A method of fabricating a column borne building construction according to claim 16, wherein one of said additional face comprises a substantially horizontal bottom face defining a polygon shape by means of a second number of bottom edges and an equal second number of bottom vertices, said bottom face being substantially perpendicular to said column and encircling said column, wherein said column coincides with a central point of said bottom face, each of said second number of bottom vertices joining two bottom edges and at least one additional edge of said polyhedron, said at least one additional edge not being a bottom edge, said column having a bottom coupling point, at least 3 of said second number of bottom vertices being connected to said column by means of a compression member, said extensions of said compression members coinciding at said bottom coupling point, and wherein an angle between each of said compression members and said substantially horizontal bottom face is in the range of 30 to 60 degrees.

18. A method according to claim 16, further comprising coupling of the edges at the vertices of the polyhedron by means of hinges.

19. A method of fabricating a column borne building construction comprising: constructing a building and one substantially vertical column for bearing the load of said building construction, said building having a polyhedron shape, said polyhedron shape being a fullerene shape, said polyhedron shape having a substantially horizontal bottom face defining a polygon shape by means of a second number of bottom edges and an equal second number of bottom vertices, said bottom face being substantially perpendicular to said column and encircling said column, wherein said column coincides with a central point of said bottom face, said polyhedron shape comprising additional faces other than said bottom face, said additional faces being defined by additional edges and additional vertices, each of said second number of bottom vertices joining two bottom edges and at least one additional edge of said polyhedron, said bottom edges and said additional edges comprising construction elements, said column having a bottom coupling point, at least 3 of said second number of bottom vertices being connected to said column by means of a compression member comprising a further construction element, the extensions of said compression members coinciding at said bottom coupling point, wherein for each compression member, the extension of said compression member lies in a common plane with at least one additional face comprising said at least one additional edge coupled to said bottom vertex connected to said column by means of said compression member, and wherein an angle between each of said compression members and said substantially horizontal bottom face is in the range of 30 to 60 degrees.

20. A method of fabricating a column borne building construction according to claim 19, wherein one of said additional face is a substantially horizontal top face defining a polygon shape by means of a first number of top edges and an equal first number of top vertices, said top face being substantially perpendicular to said column and encircling said column, wherein said column coincides with a central point of said top face, each of said first number of top vertices joining two top edges and at least one additional edge of said polyhedron, said at least one additional edge not being a top edge, said column having a top coupling point, at least 3 of said first number of top vertices being connected to said column by means of a tension member, wherein said extensions of said tension members coincide at said top coupling point, and wherein an angle between each of said tension members and said substantially horizontal top face is in the range of 30 to 60 degrees.

* * * * *